US008437685B2

(12) United States Patent
Tanaka et al.

(10) Patent No.: US 8,437,685 B2
(45) Date of Patent: May 7, 2013

(54) POST-PROCESSING APPARATUS AND IMAGE FORMING SYSTEM

(75) Inventors: Yu Tanaka, Yokohama (JP); Hiroyuki Wakabayashi, Hachioji (JP); Masaaki Uchiyama, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 389 days.

(21) Appl. No.: 12/702,565

(22) Filed: Feb. 9, 2010

(65) Prior Publication Data

US 2010/0209164 A1 Aug. 19, 2010

(30) Foreign Application Priority Data

Feb. 17, 2009 (JP) ..... 2009-033723

(51) Int. Cl.
*G03G 15/00* (2006.01)

(52) U.S. Cl.
USPC ..... 399/405; 399/407

(58) Field of Classification Search ..... 399/405
See application file for complete search history.

(56) References Cited

U.S. PATENT DOCUMENTS 3,347,396 A * 10/1967 Hohl ..... 414/789.1
5,153,663 A * 10/1992 Bober et al. ..... 399/406
5,382,011 A * 1/1995 Tani ..... 270/37
5,383,656 A * 1/1995 Mandel et al. ..... 271/258.01
6,332,606 B1 * 12/2001 Seki ..... 270/59
6,666,444 B1 * 12/2003 Paoli ..... 270/58.11
7,599,654 B2 * 10/2009 Shishikura ..... 399/405
7,672,628 B2 * 3/2010 Sato ..... 399/322
2005/0232672 A1 * 10/2005 Nakamura et al. ..... 399/405

FOREIGN PATENT DOCUMENTS

JP 08-113408 A 5/1996
JP 11-157741 A 6/1999
JP 2000-351522 A 12/2000
JP 2006-082924 A 3/2006
JP 2007-62870 A 3/2007
JP 2007-314256 A 12/2007
JP 2007-331845 A 12/2007
JP 2008-308251 A 12/2008

OTHER PUBLICATIONS

Japanese Office Action dated Nov. 20, 2012 (and English translation thereof) in counterpart Japanese Application No. 2009-033723.

* cited by examiner

*Primary Examiner* — Anthony Nguyen
(74) *Attorney, Agent, or Firm* — Holtz, Holtz, Goodman & Chick, P.C.

(57) ABSTRACT

In a post-processing apparatus in which sheets are stacked in a stacker section and arranged to be subject to post-processing, the stacker section is provided with a sheet ejection section which subsequently ejects the sheets one by one or two or more sheets overlapped with each other, wherein the sheet ejection section is provided with a corrugation application member to apply corrugation onto the sheet to be ejected and to change extent of the corrugation to be applied.

14 Claims, 11 Drawing Sheets

POST-PROCESSING APPARATUS AND IMAGE FORMING SYSTEM

This application is based on Japanese Patent Application No. 2009-033723 filed on Feb. 17, 2009, in Japanese Patent Office, the entire content of which is hereby incorporated by reference.

BACKGROUND OF THE INVENTION

The present invention relates to a post-processing apparatus to stack sheets conveyed from an image forming apparatus and to conduct arrangement and stitching processes of the sheets stacked, and an image forming system provided with the image forming apparatus and the post-processing apparatus.

TECHNICAL FIELD

There is known a post-processing apparatus to conduct stitching and hole making processes on a sheet outputted from an image forming apparatus such as a copying machine and a printer. Such post-processing apparatus is connected with an image forming apparatus to configure an image forming system and operates in conjunction with operation of the image forming apparatus. Therefore, for a high-speed image forming apparatus, a post-processing apparatus having a high speed processing ability to cope with processing speed of the image forming apparatus is needed.

However, in the process of the post-processing apparatus, since the post-process such as the stitching process is carried out after a plurality of the sheets are accumulated in a stacker, subsequent sheets cannot be conveyed while the sheets in the stacker are being subject to the post-processing.

On the other hand, since the image forming apparatus outputs the sheets with a consistent interval, it is necessary that the post-processing apparatus accepts the sheets outputted from the image forming apparatus even while post-processing is being carried out in order to prevent productivity of the image forming apparatus from decreasing.

To cope with the above problem, an additional post-processing apparatus can be disposed at an upper stream side of the post-processing apparatus which performs the stitching process and so forth. The additional post-processing apparatus, having a buffer to temporarily stop the sheets, overlays the sheet conveyed subsequently on the sheet stopped and conveys two overlaid sheets to the post-processing.

As described above, using additional post-processing the conveyance interval of the sheets conveyed to the post-processing apparatus to conduct the stitching process is widened, thus the post-processing apparatus can accept the sheet outputted from the image forming apparatus while the post-process is being carried out.

There will be described aligning of sheet edge in a post-processing section in the post-processing apparatus which lays one sheet on another to convey. FIG. 4 is a diagram describing forming of a sheet bundle PP before the stitching process.

Two sheets P laid one another having been conveyed are further conveyed to a X direction through conveyance rollers 120 and 220, and ejected to a position shown by broken lines. The ejected sheets P move to a Y direction by the gravity, and fall down to a stacker section 60 having a sheet loading surface 61, a belt B and an arrangement plate SP then edges of the sheets P come to contact with the arrangement plate SP to stop.

The edge section of the sheet bundle PP configured with the sheets P having the edges which are arranged by the arrangement plate is subject to stitching process by stitching section ST to be a booklet.

FIG. 5 is a diagram describing a state where the edge of the sheet at a lower side is not contacting with the arrangement plate.

As FIG. 4 shows, two sheets P ejected through the conveyance rollers 120 and 220 are supposed to be arranged at the edges thereof by the arrangement plate SP. However, if the conveyance rollers 120 and 220 eject the two sheets which have been conveyed being laid one another without the edges being arranged, the edge of the upper sheets P1 and the edge of the lower sheet P2 sometimes displaced each other in the Y direction as broken lines in FIG. 5 show.

In a state shown by broken lines in FIG. 4, since the upper side sheet P1 contacts with the arrangement plate SP prior to the lower side sheet P2, the lower side sheet P2 is caught between the sheets and restricted to move toward the arrangement plate SP. If this occurs, the edges of the sheets P cannot be arranged, thus a booklet having good appearance where the edges of the sheets are arranged can not be produced by stitching.

Therefore, a technology to arrange the edges of the sheets finely at the arrangement plate by displacing two sheets laid one another to be conveyed.

FIG. 6 shows a view in which the upper side sheet is ejected so as to precede the lower side sheet. In a technology disclosed in the Patent document 1: Unexamined Japanese patent application publication No. H11-157741, a plurality of conveyance paths are provide in a middle way of the conveyance route in the post-processing apparatus so that two sheets are laid one another in a way that the upper side sheet precedes the lower side sheet and are ejected to the stacker section 60. By the configuration, the state shown by FIG. 5 can be obviated, and as FIG. 6 shows, the edge of the lower side sheet P2 can contact with the arrangement plate SP prior to the edge of the upper side sheet P1 at a vicinity of the arrangement plate SP. As a result, the booklet of good appearance having arranged the edges of the sheets is produced.

Incidentally, the above post-processing apparatus conveys the sheets to the stacker one by one and has to carry out a process to form a sheet bundle by stacking conveyed the sheets, for example, a case that a sheet having images form by an image forming apparatus on both sides is subject to the post processing. Namely, in the above case, since the number of the sheets outputted from the image forming apparatus per unit time is about half of single-side printing, it is not necessary to convey the sheets two by two to the post-processing apparatus.

However, if the sheet is excessively curled, the sheet ejected from the conveyance rollers 120 and 220 advances unstably when the sheet is sent to the stacker one by one, thus the sheets cannot be stacked preferably.

To prevent such trouble, there is known a technology to concave or convex the sheet in a direction of travel (so-called corrugation)(for example, Patent Document 2: Unexamined Japanese patent application publication No. 2007-62870 and Patent Document 3:Unexamined Japanese patent application publication No. 2007-314256).

However, if two sheets having been or being subject to corrugation are ejected from the conveyance rollers 120 and 220, laying one another, a friction force between the two sheets increases due to the corrugation, thus the sheets do not slip well. As a result, it becomes difficult to eject the two sheets to the stacker with the upper side sheet being slightly ahead of the lower side sheet.

Patent document 1: Unexamined Japanese patent application publication No. H11-157741

Patent Document 2: Unexamined Japanese patent application publication No. 2007-62870

Patent Document 3: Unexamined Japanese patent application publication No. 2007-314256

SUMMARY OF THE INVENTION

One aspect of the present invention is as follow.

1. A post-processing apparatus which stacks sheets in a stacker section, and arranges and post-processes the sheets stacked, comprising:

a sheet ejection section which subsequently ejects the sheets one by one or two or more sheets overlapped with each other, displacing the sheets in a sheet ejection direction; a corrugation application member which applies corrugation onto the sheet to be ejected from the sheet ejection section; and a control section which controls extent of the corrugation to be applied to the sheet through the corrugation application member.

2. The post-processing apparatus of item 1, wherein the sheet ejection section includes;

ejection rollers facing each other which eject the sheet by rotation, and a drive shaft which retains and rotates the ejection rollers, wherein corrugation rollers represent the corrugation application member which applies corrugation onto the sheet by pressing a surface of the sheet to be ejected while rotating, wherein the corrugation rollers facing each other are retained by the drive shaft.

3. The post-processing apparatus of item 2, wherein the corrugation rollers are retained through the drive shaft in a way that the corrugation rollers can shift freely in a radial direction of the drive shaft in a predetermined range.

4. The post-processing apparatus of item 2, further comprising a bias pressure control section which changes a bias pressure applied from the rotating corrugation rollers facing each other onto the sheet, or changes a distance between the corrugation rollers.

5. The post-processing apparatus of item 4, wherein the control section controls the bias pressure control section in accordance with number of the sheets ejected from the ejection rollers at once.

6. The post-processing apparatus of item 4, wherein the control section controls the bias pressure control section in accordance with thickness or kinds of the sheets ejected from the ejection rollers.

7. An image forming system comprising;

an image forming apparatus which forms an image on the sheet, and the post-processing apparatus of any one of claims 1 to 6 which performs post-processing with respect to the sheet on which the image is formed by the image forming apparatus.

DETAILED DESCRIPTION OF THE PREFERRED EMBODIMENTS

An embodiment of the present invention will be described with reference to the drawings without being restricted by the drawings thereof.

Figure 1:
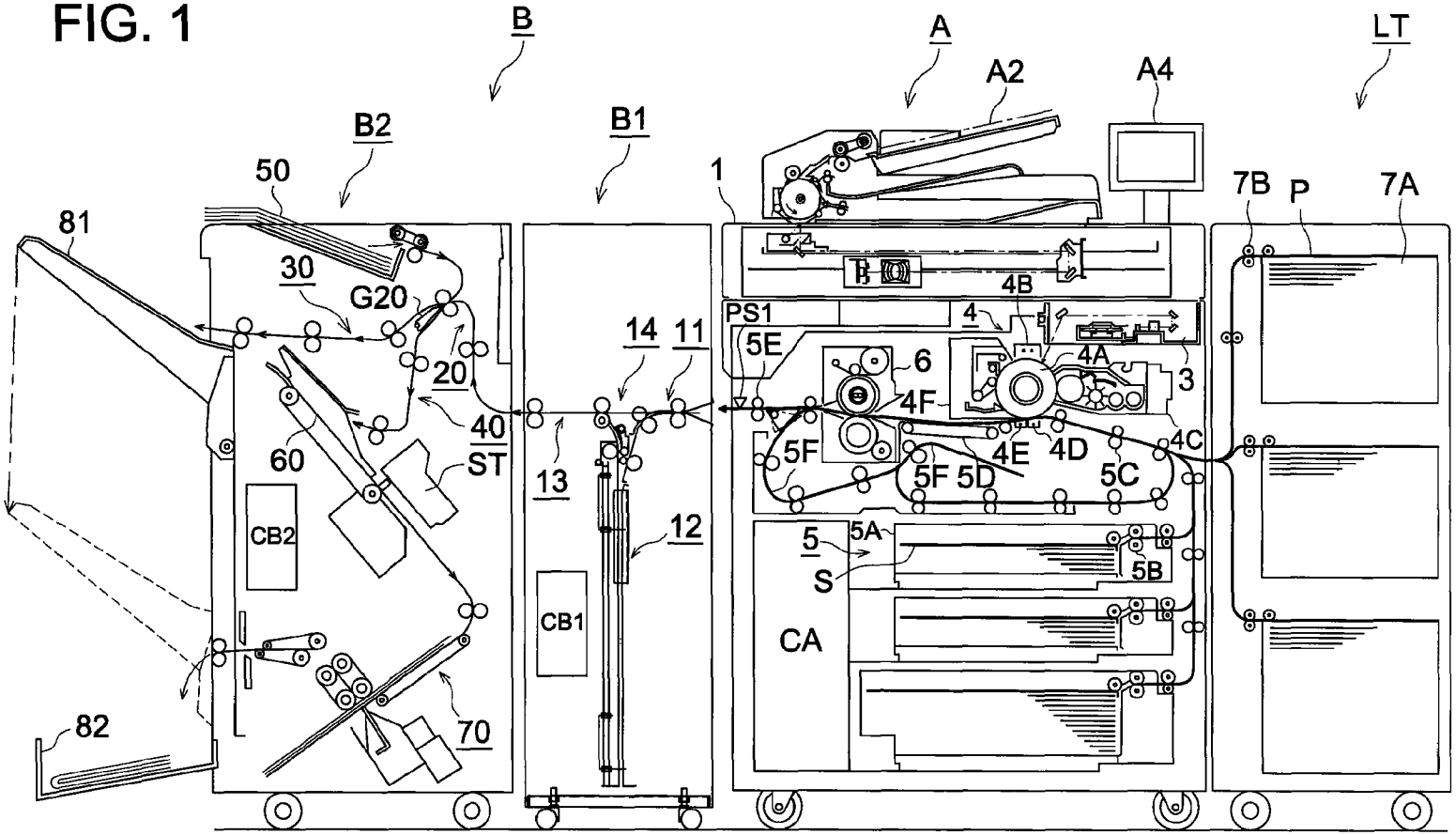
FIG. 1 is a total configuration view of an image forming system.

FIG. 1 is a total configuration view of an image forming system configured with a large capacity sheet feeding apparatus LT, an image forming apparatus A, and a post-processing apparatus B. Incidentally, the exemplified post-processing apparatus B is configured with a post-processing device B1 representing a post-processing apparatus, and a post processing device B2 representing a stitching process unit.

The large capacity sheet feeding apparatus LT is provided with a sheet stacker section 7*a*, and a first sheet feeding section 7B. In the sheet stacker section 7A, a large amount of sheets P of A4 and A3 sizes are stored. The sheets P stored are continuously sent to the image forming apparatus A.

The image forming apparatus A is configured with an image read out section 1, an image write section 3, an image forming section 4, an feeding sheet conveyance section 5, a fixing section 6, an automatic document feeding section A2, and a control section CA.

The image forming section 4 is configured with a photoconductive drum 4A, a charging section 4B, a developing section 4C, a transfer section 4D, a separating section 4E and a cleaning section 4F. The feeding sheet conveyance section 5 is configured with a feeding sheet cassette 5A, a first sheet feeding section 5B, a second sheet feeding section 5C, a conveyance section 5D, a sheet ejection section 5E and a two-side copying section 5F.

An operation display section A4 is an input and output section provided with a touch panel in which a touch screen is overlaid on a display section configured with a liquid crystal panel. An operator can display various setting screens through the operation display section A4 and can input kinds of post-processing and kinds of the sheets store in the sheet feeding cassette 5A.

From a document placed on a document table of the automatic document feeding section A2, an image of one side or images on two sides are read through an optical system of the image reading section 1 and subject to photoelectric conversion to be converted to an analogue signal. The analogue signal is stored in the control section CA as image data after processing such as A/D conversion, shading correction and image compression.

The image data stored in the control section CA is converted into image output data and sent to the image writing section 3. The image writing section 3 scans the photoconductive drum 4A of the image forming section 4 with a laser beam based on the image output data sent from the control section CA. Through the above scanning exposure an electrostatic latent image is formed on the photoconductive drum 4A.

The electrostatic latent image formed on the photoconductive drum 4A becomes a toner image through the image forming section 4 which performs processing such as charging, exposing, developing, transferring, separating and cleaning.

The toner image is transferred through a transfer section 4D onto the sheet P conveyed by a first sheet feeding section 5B or a first sheet feeding section 7B of the large capacity sheet feeding apparatus LT.

The toner image transferred onto the sheet P is fixed on the sheet P by a fixing section 6 and the sheet P on which the toner image has been fixed is sent to the post-processing apparatus B through a sheet ejection section 5E.

Incidentally, in case images are formed on two sides of the sheet P, the sheet P is tuned over upside down in the two-side copying sheet feeding section 5F after fixing, then sent to the image forming section 4 again for image forming and fixing is carried out. After that the sheet P is sent to the post-processing apparatus B.

Incidentally, the image forming apparatus A in FIG. 1 is to form a monochrome image on the sheet P, it can be the one forms a color image on the sheet P.

The post-processing apparatus B is configured with a post processing device B1 representing an intermediate conveyance unit which carries out a process to overlap sheets one another and the post-processing device B2 which carries out a stitching process. Incidentally, in the present embodiment while the post-processing device B1 and the post-processing device B2 have dependent housings, the housings can be integrated to be one housing.

The post-processing device B1 is configured with a sheet accepting section 11, an accumulation section (overlapping section) 12, a sheet ejection section 13, a by-pass conveyance section 14, a control section CB1. The post-processing device B1 can overlap two sheets outputted from the image forming apparatus A one another at the accumulation section 12. The two overlapped sheets are turned over upside down with being overlapped and conveyed to the post-processing device B2. A sheet not to be turning over or the sheet not to be subject to the stitching process is conveyed to the post-processing device B2 via the by-pass conveyance section 14 without passing through the accumulation section 12.

The post-processing device B2 is provided with an inlet conveyance section 20, an ejection sheet conveyance section 30, a conveyance section 40, an insert sheet feeding section 50, a stacker section 60, a stitching process section ST, and a folding section 70. The sheet P conveyed from the conveyance section 40 is stacked in the stacker section 60, and subject to the stitching process in the stitching process section ST representing the post-processing section. As a result, one booklet configured with a plurality of the sheets P is produced.

In case of side stitching where the sheet bundle is stitched at one side, the booklet is ejected to a sheet ejection tray 81, and in case of saddle stitching where the sheet bundle is stitched at a center portion of the sheet, the sheet bundle is folded by the folding section 70 at the center and ejected to a sheet ejection tray 82.

Incidentally, while the post-processing device B2 of the present embodiment is to perform the stitching process for a plurality of sheets P, it can be the post-processing device to perform application of glue onto the plurality of the sheets P to form the booklet, or to perform a hole punching process.

Figure 2:
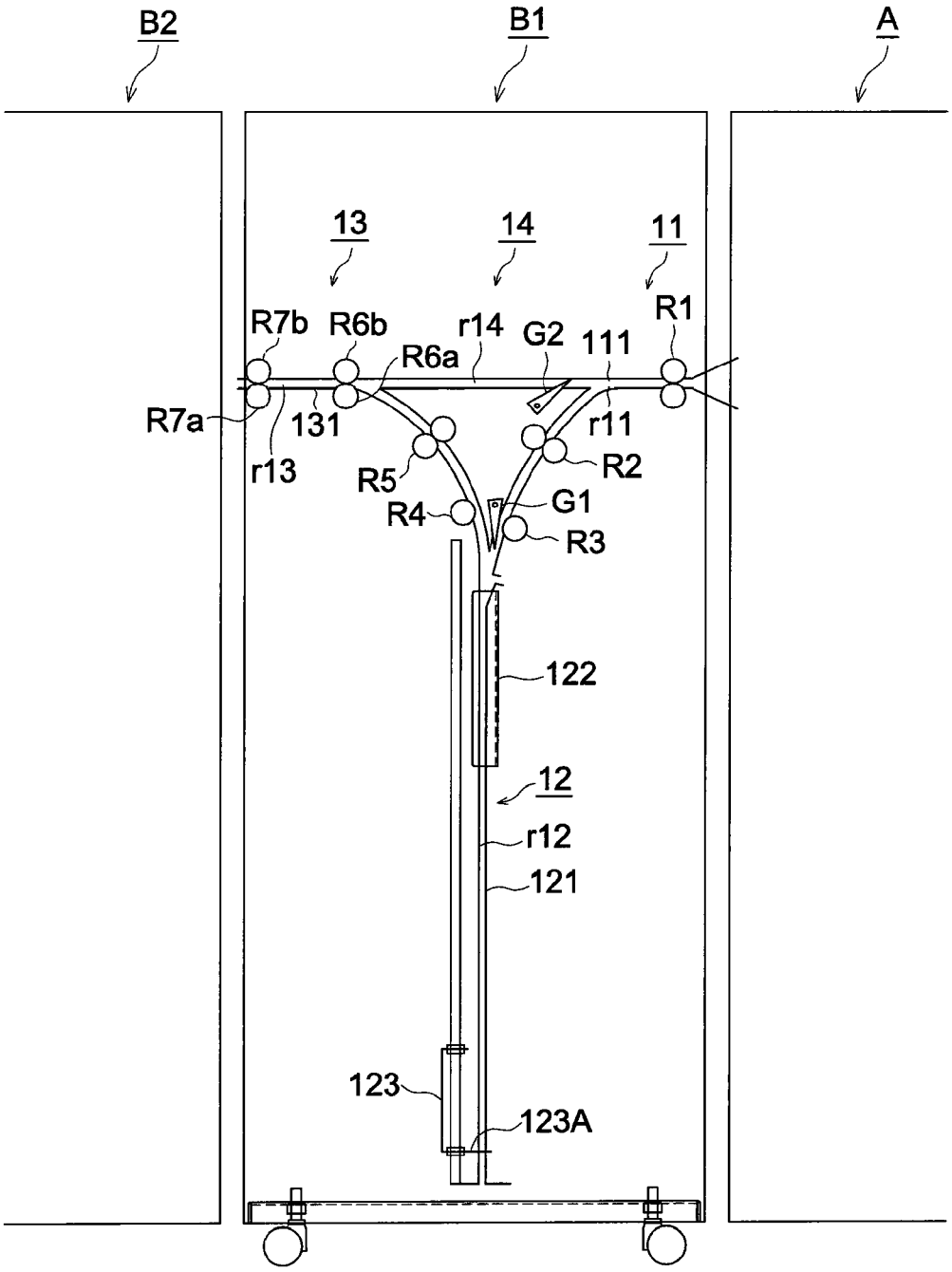
FIG. 2 is a front cross-sectional view of an intermediate conveyance device.

FIG. 2 is a front cross-sectional view of the post-processing device B1. The post processing device B1 is configured with the sheet accepting section 11, the accumulation section 12, the sheet ejection section 13, and the by-pass conveyance section 14.

The sheet accepting section 11 is provided with conveyance rollers R1 and R2, a sheet conveyance path r11 having a guide plate 111. The sheet accepting section 11 subsequently accepts and conveys the sheet P ejected from the sheet ejection section 5E of the image forming apparatus A.

The accumulation section 12 is provided with two guide plates 121 disposed in parallel each other, a longitudinal aligning section configured with a stop member 123 and so forth, a lateral aligning member 122, a conveyance drive roller R3, an ejection drive roller R4 and a sheet conveyance path r12. When the stitching process is performed by the post-processing device B2, the sheet p accepted from the sheet accepting section 11 is stored in the accumulation section 12, and ejected to upward. For a specific job in which the stitching process is carried out, two sheets are overlapped in the accumulating section 12 and the two sheets being overlapped each other are ejected upward.

The sheet ejection section 13 is provided with an intermediate conveyance roller R5, sheet ejection rollers R6*a*, R6*b*, R7*a*, and R7*b* and a sheet conveyance path r13 having a guide plate 131. In the sheet ejection section 13, the sheet P (occasionally two sheets overlapped each other in the accumulation section 12) stored in the accumulation section 12 is turned over upside down and conveyed to the post-processing device B2.

The by-pass conveyance section 14 is provided with a sheet conveyance path r14. The sheet P is conveyed to the by-pass conveyance section 14 if the sheet is not necessary to be conveyed to the accumulation section 12, for example, in case the stitching process for the sheet P is not necessary or the sheet P is ejected without being turned over.

The conveyance path changeover section G2 disposed at the sheet accepting section 11 branches the sheet P to the accumulation section 12 or to the by-pass conveyance section 14. Above the accumulation section 12, a conveyance path changeover section G1 is disposed. The conveyance path changeover section G1 switches between introducing the sheet P to the accumulation section 12 and ejecting the sheet P from the accumulation section 12. The conveyance path changeover sections G1 and G2 are connected with solenoids respectively to be driven.

Such post-processing device B1 conveys the two sheets P after overlapping in the accumulation section 12 to the post-processing device B2, whereby the post processing device B1 enables to delay the conveyance time of sheets P to the post processing device B2. Thus, the execution time of post-processing in the post-processing device B2 can be acquired. As a result, decreasing of the productivity of the sheet outputted from the image forming apparatus A is obviated. Incidentally, the number of the sheets overlapped in the accumulation section 12 is not limited to two. It can be three or more by repeating operation of the conveyance path changeover section G1 and the stop member 123.

Figure 3:
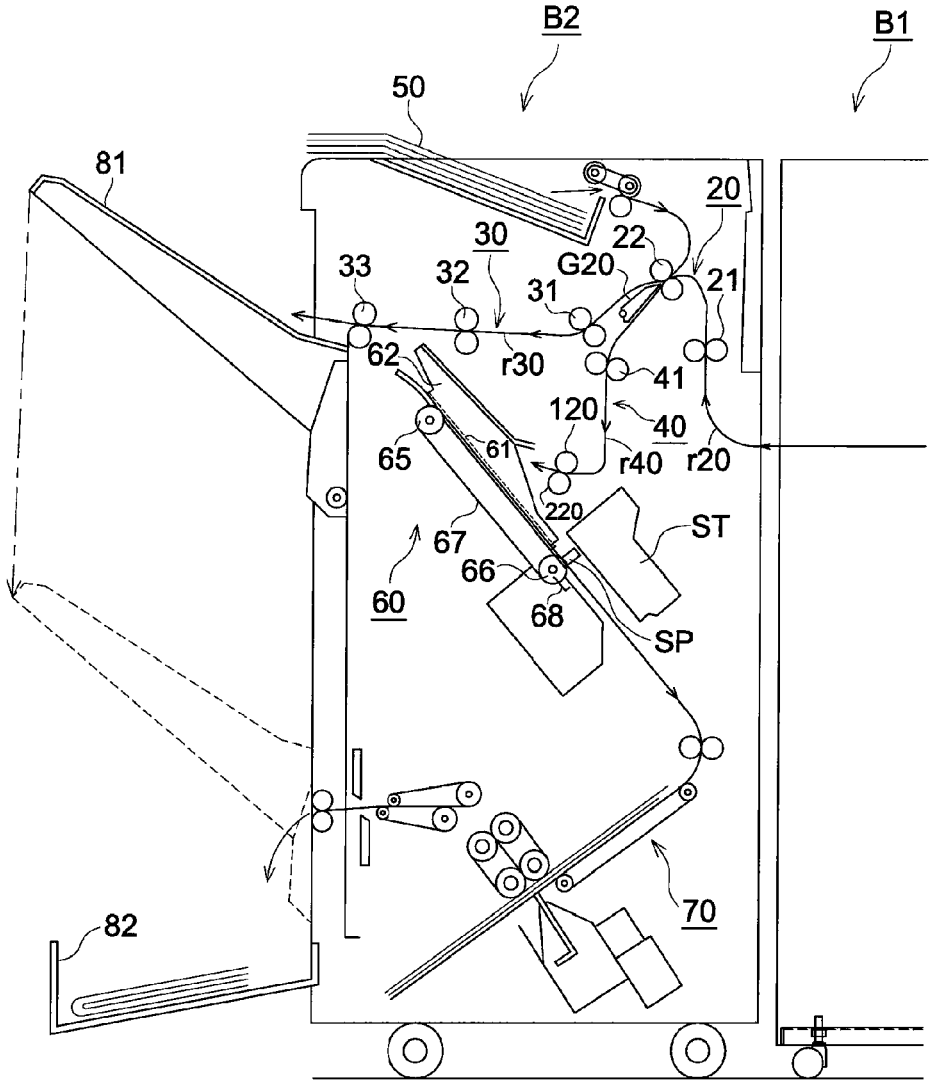
FIG. 3 is a front cross-sectional view of post-processing apparatus.
Figure 4:
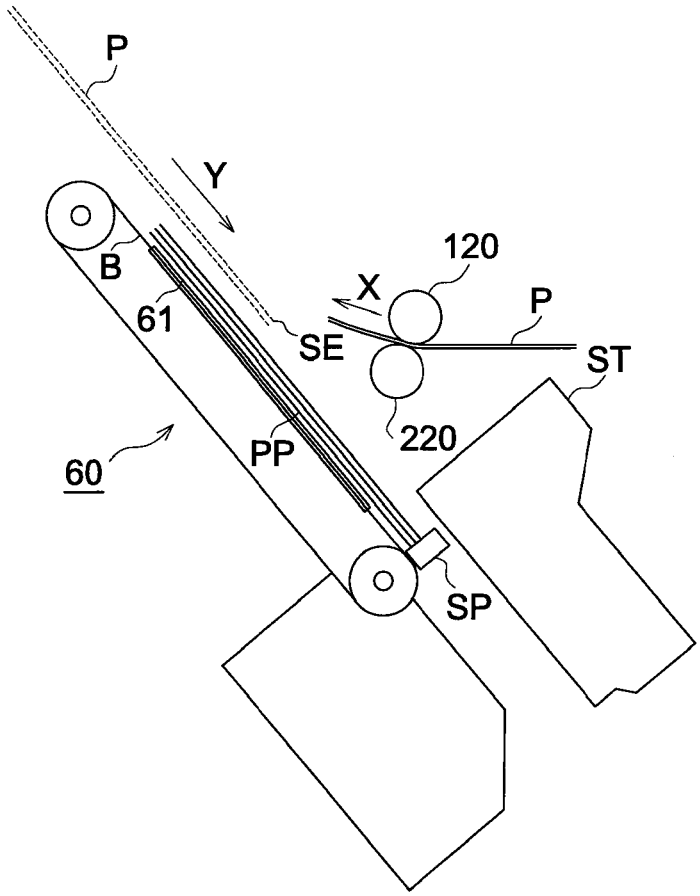
FIG. 4 is a diagram to describe forming of a sheet bundle before a stitching process is carried out.

FIG. 3 is a front cross-sectional view of the post-processing device B2. The post processing device B2 is provided with an inlet conveyance section r20, a sheet ejection conveyance path r30 and a connecting conveyance path r40 as conveyance paths.

The sheet P conveyed from the post-processing device B1 is conveyed at the inlet conveyance path r20 and introduced to the ejection sheet conveyance path r30 or the connecting conveyance path r40 through the conveyance path changeover section G20 depending on whether or not the stitching process is carried out. The conveyance path changeover section G20 is operated by an unillustrated solenoid.

The entrance conveyance section 20 disposed at the inlet conveyance path r20 has pairs of conveyance rollers 21 and 22 driven by an unillustrated motor to be rotated in the same circumferential speed. The conveyance roller pairs 21 and 22 grasp the sheet P in the inlet conveyance path r20 to convey it.

The ejection sheet conveyance section 30 disposed at the ejection sheet conveyance path r30 is provided with conveyance roller pairs 31, 32 and 33 which are driven by an unillustrated motor to be rotated in the same circumferential speed. The conveyance roller pairs 31, 32 and 33 grasp the sheet P conveyed from the ejection sheet conveyance path r30 to convey it.

The connecting conveyance section 40 disposed at the connecting conveyance path r40 is provided with conveyance roller pairs 41 and 42 which are driven by an unillustrated motor to be rotated in the same circumferential speed. The conveyance roller pairs 41 and 42 grasp the sheet P conveyed from the connecting conveyance path r40 to convey it.

In case the stitching process is not performed for the sheet P, the sheet P from the post-processing device B1 received by the inlet conveyance path r20 is led to the ejection sheet conveyance path r30 through the conveyance path changeover section G20 and grasped by the conveyance roller pairs 31 and 32, and the ejection roller pair 33 to be conveyed and ejected to an ejection sheet tray 81 outside the apparatus.

On the other hand, in case the stitching process is carried out for the sheet P, the sheet P received via the accumulation section 12 of the post-processing device B1 is led to the connecting conveyance path r40 through the conveyance path changeover section G20 and grasped by the conveyance roller pair of the connecting conveyance section 40 to be conveyed to the stitching section ST.

The two sheets P overlapped with each other in the accumulation section 12 are conveyed through the conveyance roller pair 41 at the connecting conveyance section 40 and reach at ejection rollers 120 and 220, after that ejected to a space above the stacker section 60 representing a stacker disposed in oblique manner. The two sheets P ejected moves downward along a loading plate 61 by the gravity and the edges of the sheets come to contact with the arrangement plate SP to stop. As above, the edges of the sheets P at an upstream side in the conveyance direction are arranged.

Numeral 62 is a pair of arrangement members disposed in movable manner at both side surfaces of the stacker section 60, the arrangement members 62 can be moved in a direction perpendicular to the conveyance direction of the sheet P. When the sheet ejected above the stacker section 60 is received, the arrangement members are opened to be wider than the width of the sheet P. When the sheet P slides on the stacker section 60 and stops at a predetermined position by contacting with the arrangement plate SP, the arrangement member lightly hits side edges of the sheets to arrange the sheet bundle in the width direction.

On the stacker 60, when a last page of the sheet bundle is placed and arrangement of the sheet bundle is completed, stapling by the stitching process section ST representing a stapler is carried out so as to stitching the sheet bundle. Thus the booklet is formed.

A notch section is formed on a portion of the sheet loading surface 61 of the stacker section 60. A plurality of ejection belts 67 installed on a drive pulley 65 and driven pulley 66 are driven by driving the drive pulley which is driven by an illustrated motor. On a portion of the ejection belt 67, ejection claws 68 are formed integrally. When side stitching is carried out by the stitching process section ST, a stitched booklet is held by the ejection claws 68 of the ejection belt 67 and pushed upward obliquely sliding on the loading surface of the stacker section 60 and conveyed to a nip position of the ejection roller pair 33. Then the booklet is ejected and loaded onto the ejection sheet tray 81, being grasped by the ejection roller pair 33.

In case of so-called saddle stitching in which stitching is carried out by the stitching process section at the center section of the sheet bundle, the sheet bundle having been stitched is folded at the center section by a saddle folding section 70 and ejected to the sheet ejection tray 82.

In case the stitching process is consecutively carried out, after a last page of a preceding sheet bundle is placed on the stacker section 60 and arranged, the sheets P configuring the successive sheet bundle cannot be conveyed to the stacker 60 until the sheet bundle is removed form the stacker section 60. By ejecting the booklet formed, when the booklet is removed from the stacker section 60, the sheets P configuring the successive sheet bundle can be loaded on the stacker 60.

As described above, in case two sheets P are stacked in the post-processing device B1, the two sheets P overlapped with each other are conveyed to the connection conveyance section 40 of the post-processing device B2 with being overlapped with each other and ejected to the upper space of the stacker section 60 through the ejection rollers 120 and 220. The two ejected sheets P fall on the stacker section 60 and come to contact with the arrangement plate SP so that the edge section of the sheet bundle is arranged.

However, in the ejected two sheets, the upper side sheet P1 contact with the arrangement plate SP prior to the lower side sheet P2, movement of the lower side sheet P2 is restricted between the sheets, resulting in the edge of the lower sheet P2 not being contact with the arrangement plate SP.

Figure 5:
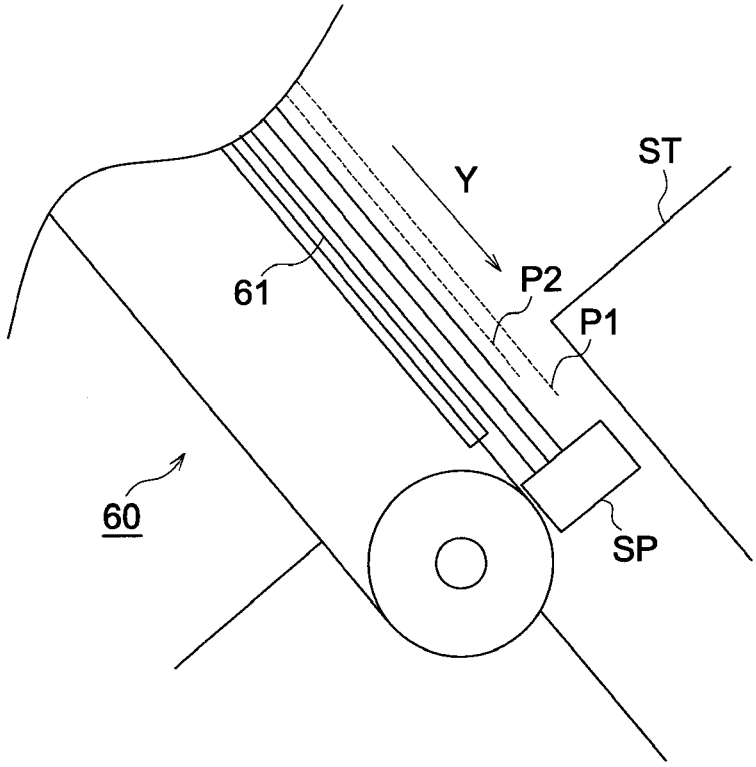
FIG. 5 is a diagram to describe a state where an edge section of a lower side sheet is no in contact with an arrangement plate.

FIG. 5 is a diagram explaining a state where the lower sheet P2 is not in contact with the arrangement plate SP.

In the state shown in the FIG. 5, the edges of the sheets P are not arranged. As a result, the good appearance booklet having the edges being arranged is not formed even if stitching process by the stitching process section ST is carried out.

Thus, there is employed a technology that the upper side sheet precedes the lower sheet within the two sheets ejected from the ejection rollers 120 and 220 to the stacker section 60.

Figure 6:
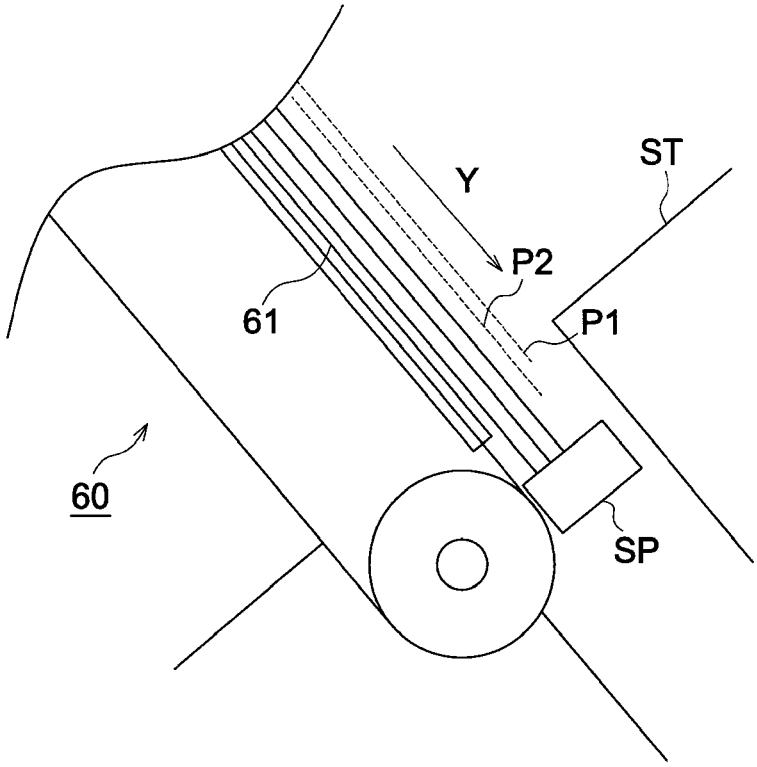
FIG. 6 is a diagram describing a case where two sheets are sent so that the upper side sheet precedes a lower side sheet.

FIG. 6 is a diagram showing the upper sheet P1 is ejected so as to precede the lower sheet P2.

Namely, the ejection rollers 120 and 220 are driven by separate motors, so that a circumferential speed of the ejection roller 120 is faster than that of the ejection roller 220, whereby the upper side sheet P1 precedes the lower side sheet P2 with the two sheets being grasped. By ejecting the two sheets in the above manner, the edge of the lower side sheet P2 comes in contact with the arrangement plate SP prior to the edge of upper side sheet P1, whereby the trouble caused by the state in FIG. 5 does not occur.

Meanwhile, a toque limiter is provided inside the ejection roller 220. In case one sheet is grasped by the ejection rollers 120 and 220, the ejection roller 220 follows the circumferential speed of the ejection roller 120 to eject the sheet. Also, in case the ejection rollers 120 and 220 grasp no sheet, the ejection roller 220 rotates, following the circumferential speed of the ejection roller 120.

The pressure load between the ejection rollers 120 and 220 may be adjusted to accord with the above operation. Between the rollers 120 and 220, a bias force is applied by a bias spring and so forth so that the two rollers facing each other press each other. When one sheet is ejected, the pressure force is increased compared to that when two sheets are ejected.

As above, the technology, where the sheets P are conveyed two by two to the stacker section 60 and the edges of the sheets P stacked on the stacker section 60 are arranged has been described. As mentioned above, the post-processing apparatus in the foregoing can send the sheets one by one to the stacker section 60 and accumulate the sheet to form the sheet bundle.

For example, in case an outputted sheet P having images formed on the both sides by the image forming apparatus is subject to post-processing. The number of the sheets outputted form the image forming apparatus per unit time is about half of the single side printing, thus the sheet does not have to be sent two by two.

Therefore, it is not necessary to displace the overlapped two sheets when the overlapped two sheets are ejected by the ejection rollers 120 and 220. However it is necessary to cope with a newly created problem, in case sheet P is ejected to the stacker section 60 one by one. Namely, in case curling of the sheet P ejected by the ejection rollers 120 and 220 is excessive, since the traveling direction of front edge of the sheet becomes unstable, it is necessary to cope with a problem that the sheet P is not accumulated in a preferable form in the stacker section 60.

As mentioned in the foregoing, to prevent the above problem, a curve in shapes of concave or convex (corrugation) in the traveling direction is applied to the sheet P. However, in a configuration where the overlapped two sheets to which the corrugation has been applied or the corrugation is being applied is ejected by the ejection rollers 120 and 220, the friction force between the sheets increases due to the applied corrugation and then they do not slip well. As a result, it becomes difficult to eject the two sheets to the stacker section 60 with the two sheets being overlapped in a state where the upper side sheet P1 is slightly preceding the lower side sheet P2.

In the present embodiment, there is realized the post processing apparatus in which displacing of the two overlapped sheets and application of corrugation for one sheet are unfailingly performed.

Figure 7:
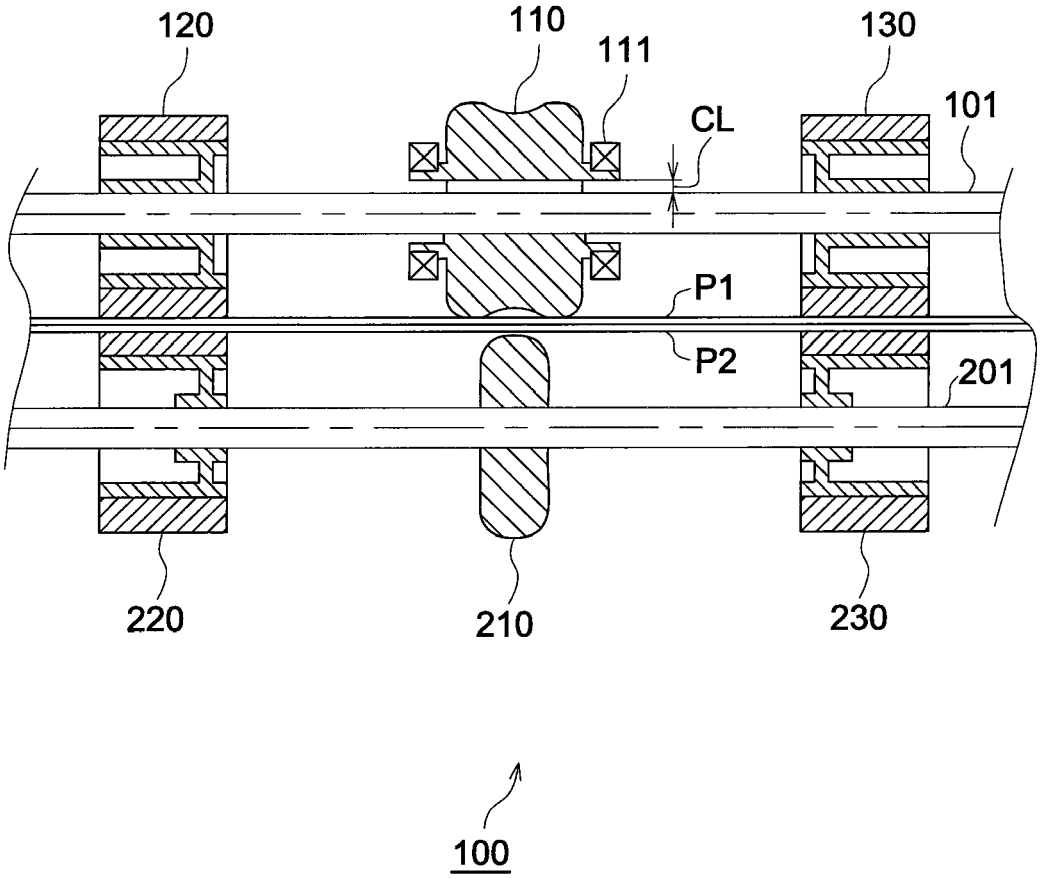
FIG. 7 is a diagram to describe corrugation rollers in a sheet ejection section.

FIG. 7 is a diagram describing corrugation rollers 110 and 210 of the sheet ejection section 100.

The sheet ejection section 100 is provided with a drive shaft 101 driven by a first drive motor (unillustrated) and a drive shaft 201 driven by a second drive motor (unillustrated). At the drive shaft 101, a corrugation roller 110 and ejection rollers 120 and 130 are disposed. In the same manner, at the drive shaft 201, a corrugation roller 210 and ejection rollers 220 and 230 are disposed.

Incidentally, the corrugation roller 110 is disposed having a clearance CL between the drive shaft 101. The corrugation roller 110 is disposed in a detachable manner in respect to the corrugation roller 210 and shift in a radial direction within a predetermined range which is determined in accordance with extent of the clearance.

FIG. 7 shows a state where the corrugation roller 110 is shifted upward through the two sheets P1 and P2 which are grasped by the ejection rollers 120 and 220, and the ejection rollers 130 and 230, and supported by the corrugation roller 210 from a lower surface. Namely, since only a weight of corrugation roller 110 is applied to the two sheets P1 and P2, the corrugation roller 110 is raised upward through rigidities of the two sheets P1 and P2.

In the above state, as mentioned in the foregoing, the sheet P1 is ejected to precede the sheet P2 through the ejection rollers 120 and 220 as well as the ejection rollers 130 and 230 without the corrugation being applied to the two sheets P1 and P2.

Figure 8:
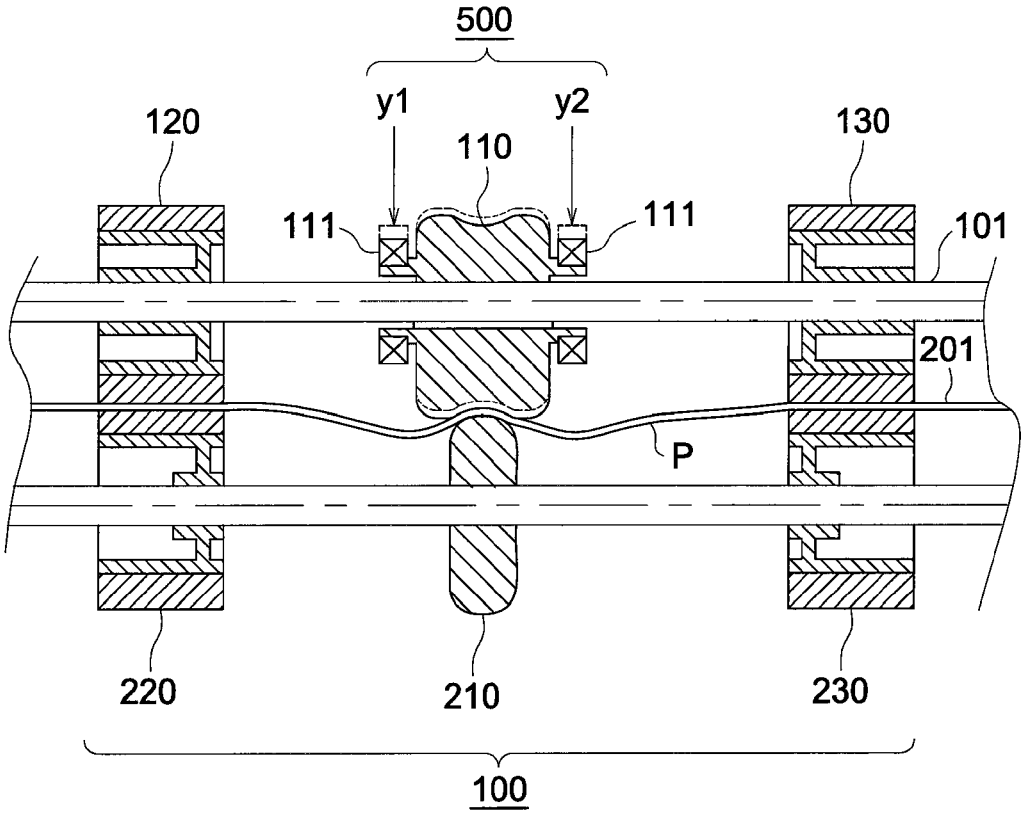
FIG. 8 is a diagram to describe application of corrugation.
Figure 9A:
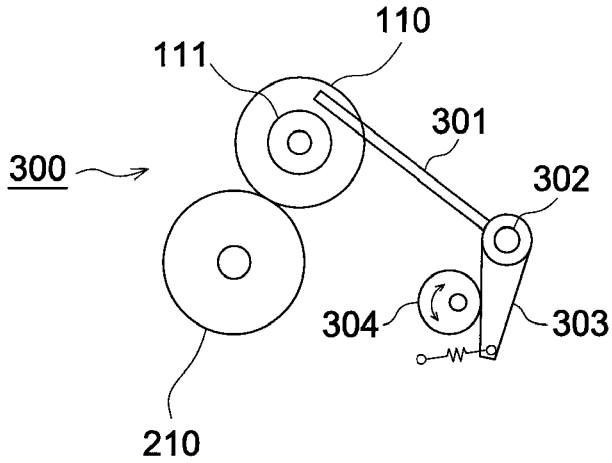
FIG. 9 is a schematic diagram of a bias pressure changing section.
Figure 9B:
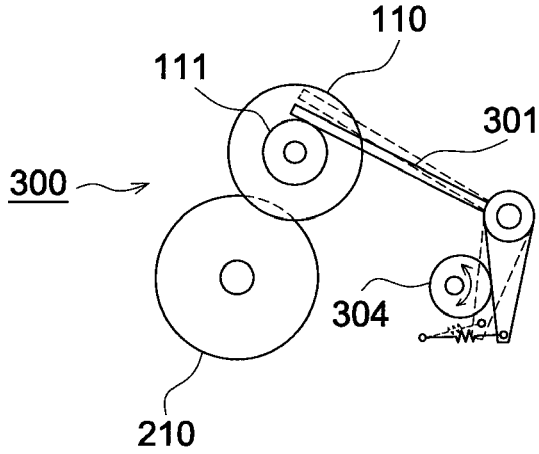

FIG. 8 is a diagram to describe application of the corrugation. Also, FIG. 9 is a schematic diagram of a pressure changing section 300.

A corrugation application member 500 is configured with the corrugation rollers 110 and 210 and a bias pressure changing section 300.

The corrugation roller 100 which can shift in the radial direction of the drive shaft slightly is located at broken line's position in the figure by the rigidity of the sheet P. When pressure is applied in a direction shown by arrows y1 and y2 through the bias pressure changing section 300, the corrugation roller 110 is pushed down towards the corrugation roller 210.

As a result, the sheet P is pressed through the corrugation roller 110 and the corrugation roller 210 below the corrugation roller 110 and deformed as the figure shows. Such deformation in the shape of concave and convex extending in the traveling direction of the sheet P is called corrugation.

The sheet P to which the corrugation is applied is difficult to bend even after the sheet is ejected through the ejection rollers 120 and 220, and ejection rollers 130 and 230. Thus the sheet P can be stacked in the stacker section 60 in a preferable manner.

The bias pressure changing section 300 is a device to press the corrugation roller 110, which can shift in the radial direction of the drive shaft 101 within the predetermined range, towards the corrugation roller 210. The bias pressure changing section 300 is configured with a leaf spring 301, a shaft 302, a lever 303, an eccentric cam 304 and a cam drive motor CM (unillustrated).

A magnitude of the bias pressure applied to the sheet P through the corrugation roller 110 is determined by the leaf spring 301 which presses an outer ring of a bearing 111 fixed at a side section of the corrugation roller.

The leaf spring 301 is moved by a lever 303 which moves in a rotation manner with the leaf spring 301 centering around an axis 302.

The lever 303 is moved by the eccentric cam 304 which rotates, being contact with the lever 303.

In the above configuration, the magnitude of the bias pressure applied to the sheet P through the corrugation roller 110 can be changed in accordance with a position where the eccentric cam 304 stops.

While the present example is to change the extent of the corrugation by changing the bias pressure of the corrugation roller 110 applied to the sheet P, the extent of the corrugation can be changed by changing a distance between the corrugation rollers 110 and 210 which are disposed face to face each other.

Figure 10:
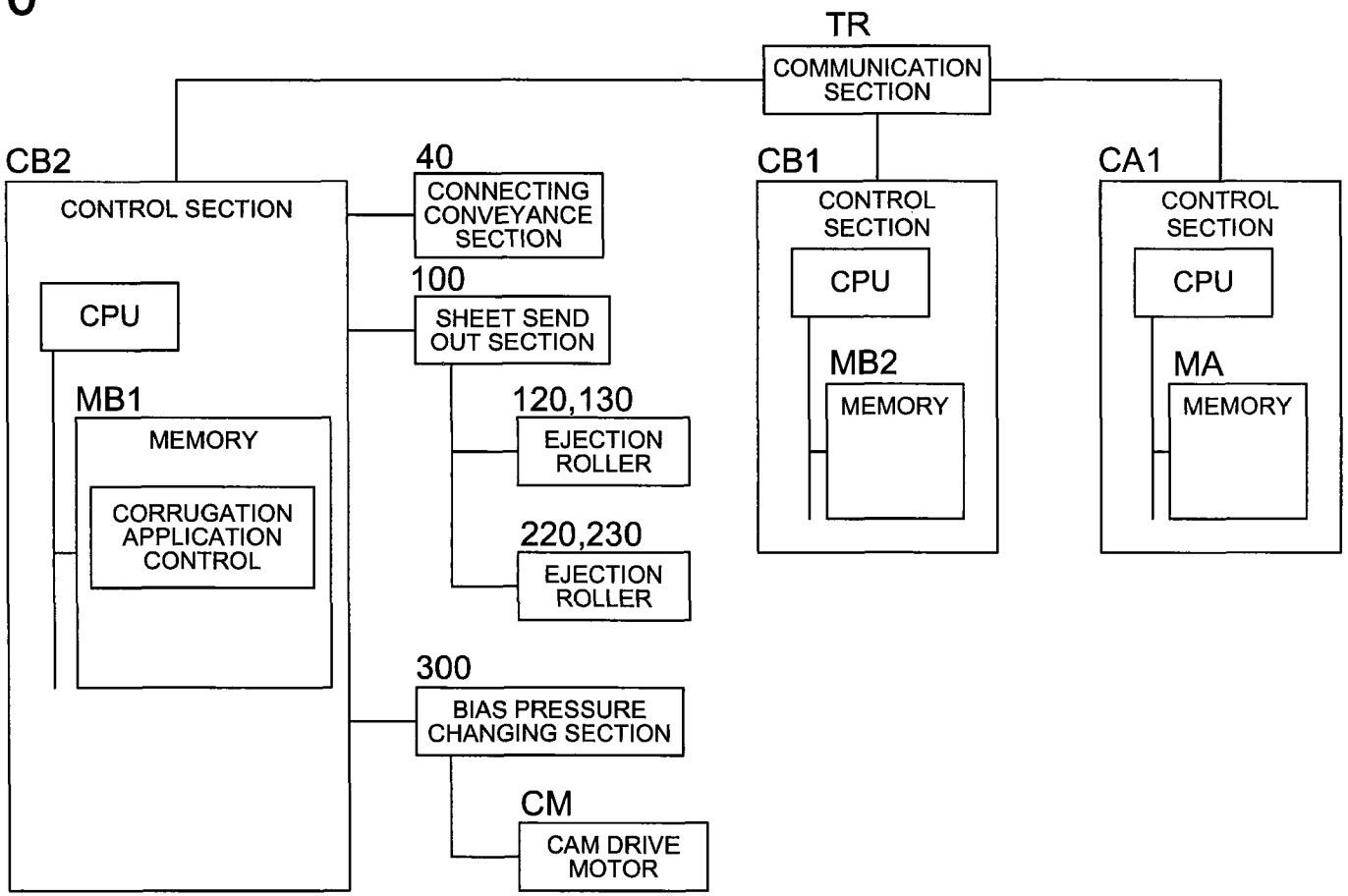
FIG. 10 is a block diagram to show control of an image forming system.

FIG. 10 is a block diagram showing control of the image forming system of the present embodiment.

A control section CA1 of the image forming apparatus A, a control section CB1 of the post processing device B1 and a control section CB2 of the post processing device B2 are computer systems provided with a CPU, a memory, an input/output I/O, a drive circuitry and a communication interace respectively. Each control section carries out control by executing a predetermined program stored in the memory. Also, the above control sections can communicate each other via a communication device TR.

The control section CB2 judges whether the sheets are ejected form the ejection rollers 120 and 220 one by one or two by two based on information sent from the image forming apparatus. If the result of the judgment is one by one, corrugation is applied, and if it is two by two, the control section CB2 rotates the eccentric cam 304 of the bias pressure changing section 300 so that corrugation is not applied.

Figure 11:
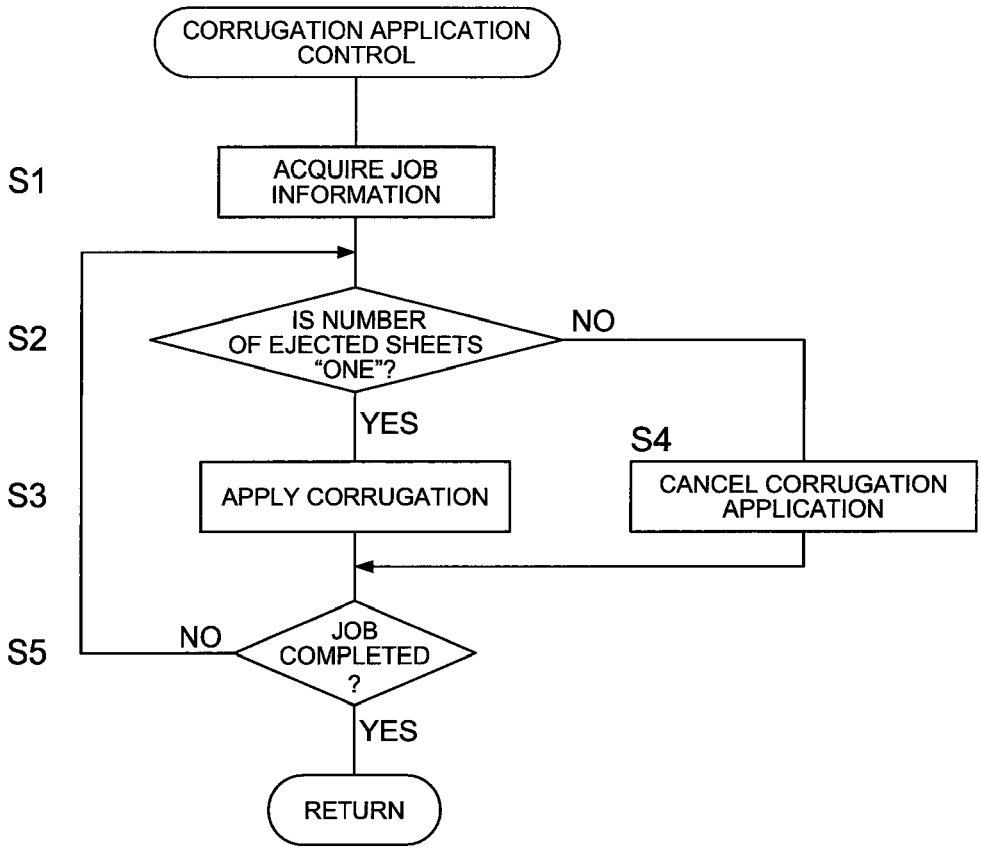
FIG. 11 is a flow chart showing a control flow of corrugation application.

FIG. 11 is a flow chart showing the control of corrugation application.

The control section CB2 of the post-processing device B2 receives job information set by an operator through an operation display section A4 of the image forming apparatus A from the control section CA (Step S1), and judges whether the sheets are conveyed to the post processing device B2 one by one or two by two (Step 2).

If the sheets are conveyed one by one (step S2: Y), the cam drive motor CM of the bias pressure changing section 300 rotates and stops so that the eccentric cam 304 comes to a position where corrugation is applied to the sheet P (step S3). If it is two by two (Step S2: N), the cam drive motor CM of the bias pressure changing section 300 rotates and stops so that the eccentric cam 304 comes to a position where corrugation is not applied to the sheet P (step S4).

In case the job is continued (step S5: N), step S2 to Step S5 are repeated, and when conveyance of a last sheet P of the job is completed (Step S5: Y), the operation flow exits from the operation routine.

The above corrugation application control is an example where whether or not the corrugation is applied is determined in accordance with the number of the sheets ejected. In the post-processing apparatus controlled as above, extent of the corrugation can be changed by changing the stop position of the eccentric cam 304 of the bias pressure changing section 300 in accordance with the number, the thickness and the kinds of the sheets ejected.

As described in the forgoing, according to the present embodiments, a post-processing apparatus is realized in which sheets are stacked in the stacker section, arranged and stitched, wherein the sheet ejection section to eject two sheets being overlapped each other to the stacker can change the extent of the corrugation in accordance with the number of the sheets ejected.

Incidentally, in the image forming system shown in FIG. 1, while each of the image forming apparatus A, post-processing device B1 and the post processing device B2 has dependent housings, these three apparatuses can be installed in one housing or two housings. Also, three or more sheets can be overlapped and sent to the stacker section.

The prevent embodiment realize a post-processing apparatus which arranges and post-processes sheets stacked in a stacker section and is capable of changing extent of corrugation applying onto the sheet to be ejected from a sheet ejection section in accordance with number of the sheets ejected at once.

As a result, when one sheet is ejected, a predetermined extent of corrugation is applied to the sheet and when two or more sheets are ejected, mild corrugation or no corrugation is applied. Thus stability when one sheet is ejected and an assuredness to displace the two sheets when two or more sheets are ejected can be realized.

What is claimed is:

1. A post-processing apparatus which stacks sheets in a stacker section, and arranges and post-processes the stacked sheets, the apparatus comprising:

a sheet ejection section which is adapted to subsequently eject the sheets one by one in a first mode, and to subsequently eject two or more of the sheets overlapped with each other in a second mode, wherein a bottom sheet is ejected in a sheet ejection direction behind sheets thereon in the second mode;

a corrugation application member which applies corrugation onto a sheet to be ejected from the sheet ejection section; and a control section which controls an extent of the corrugation to be applied to the sheet through the corrugation application member.

2. The post-processing apparatus of claim 1, wherein the sheet ejection section includes:

ejection rollers facing each other which eject the sheet by rotation, and a drive shaft which retains and rotates the ejection rollers, wherein the corrugation application member includes corrugation rollers which apply the corrugation onto the sheet by pressing a surface of the sheet to be ejected while rotating, wherein the corrugation rollers face each other and are retained by the drive shaft.

3. The post-processing apparatus of claim 2, wherein the corrugation rollers are retained in such a way that a first corrugation roller approaches to and recedes from a second corrugation roller.

4. The post-processing apparatus of claim 2, further comprising a bias pressure control section which changes a bias pressure applied from the rotating corrugation rollers facing each other onto the sheet, or which changes a distance between the corrugation rollers.

5. The post-processing apparatus of claim 4, wherein the control section controls the bias pressure control section in accordance with a number of the sheets ejected from the ejection rollers at once.

6. The post-processing apparatus of claim 4, wherein the control section controls the bias pressure control section in accordance with at least one of a thickness and a kind of the sheets ejected from the ejection rollers.

7. An image forming system comprising:

an image forming apparatus which forms an image on the sheet, and the post-processing apparatus of claim 1 which performs post-processing with respect to the sheet on which the image is formed by the image forming apparatus.

8. An image forming system comprising:

an image forming apparatus which forms an image on the sheet, and the post-processing apparatus of claim 2 which performs post-processing with respect to the sheet on which the image is formed by the image forming apparatus.

9. An image forming system comprising:

an image forming apparatus which forms an image on the sheet, and the post-processing apparatus of claim 3 which performs post-processing with respect to the sheet on which the image is formed by the image forming apparatus.

10. An image forming system comprising:

an image forming apparatus which forms an image on the sheet, and the post-processing apparatus of claim 4 which performs post processing with respect to the sheet on which the image is formed by the image forming apparatus.

11. An image forming system comprising:

an image forming apparatus which forms an image on the sheet, and the post-processing apparatus of claim 5 which performs post-processing with respect to the sheet on which the image is formed by the image forming apparatus.

12. An image forming system comprising:

an image forming apparatus which forms an image on the sheet, and the post-processing apparatus of claim 6 which performs post-processing with respect to the sheet on which the image is formed by the image forming apparatus.

13. A post-processing apparatus which stacks sheets in a stacker section, and arranges and post-processes the stacked sheets, the apparatus comprising:

a sheet ejection section which is adapted to subsequently eject the sheets one by one in a first mode, and to subsequently eject two or more of the sheets overlapped with each other in a second mode, wherein a bottom sheet is ejected in a sheet ejection direction behind sheets thereon in the second mode;

a corrugation application member which applies corrugation onto a sheet to be ejected from the sheet ejection section; and a control section which controls an extent of the corrugation to be applied to the sheet through the corrugation application member in accordance with a number of the sheets to be simultaneously ejected from the sheet ejection section.

14. The post-processing apparatus of claim 13 wherein, the corrugation to be applied to the sheet varies in accordance with whether the sheet is conveyed in the first mode or in the second mode.

* * * * *